United States Patent [19]

Marburger et al.

[11] 3,946,969

[45] Mar. 30, 1976

[54] FOLDING TAIL FINS

[75] Inventors: Ivan L. Marburger, Upland, Calif.; Donald E. Howlett, Reno, Nev.; Lawrence J. Nagel, La Verne, Calif.

[73] Assignee: The United States of America as represented by the Secretary of the Army, Washington, D.C.

[22] Filed: July 30, 1974

[21] Appl. No.: 493,005

[52] U.S. Cl. ..... 244/3.28

[51] Int. Cl.[2] ..... F42B 13/32

[58] Field of Search ..... 244/3.27, 3.28

[56] References Cited

UNITED STATES PATENTS 3,098,446 7/1963 Jasse ..... 244/3.28

3,783,738 1/1974 Pelat ..... 89/44 R

FOREIGN PATENTS OR APPLICATIONS 1,418,696 10/1965 France ..... 244/3.28

*Primary Examiner*—Verlin R. Pendegrass

*Attorney, Agent, or Firm*—Nathan Edelberg; Robert P. Gibson; Herbert H. Murray

[57] ABSTRACT

A rocket having flip out tail fins with cooperating surfaces on said fins and the rear of said rocket to maintain said fins in extended position. Spring means for urging said cooperating surfaces into engagement with each other.

2 Claims, 11 Drawing Figures

FOLDING TAIL FINS

BACKGROUND OF THE INVENTION

In a tube launched rocket the tail fin structure must be capable of being folded or retracted to within the missile profile while the missile is within the launch tube. The fins must then be capable of extension into the air stream after launch. Means must be provided to firmly maintain said fins in their extended position.

In accordance with the need it is an object of this invention to provide a flip out fin structure which can be maintained in its extended position.

DETAILED DESCRIPTION OF THE INVENTION

Figure 3:
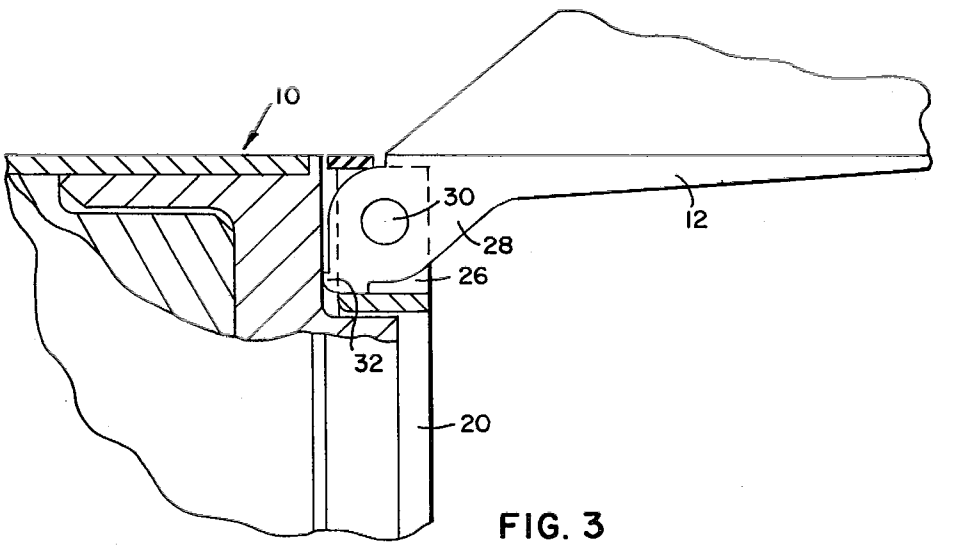
FIG. 3 is a similar view to FIG. 2 showing the fin in extended position.

Referring now to the drawings and particularly to FIGS. 1 through 5, 10 generally indicates the rear portion of a missile. Four fins, only three of which are shown at 12, 14, and 16, are attached to the rear end of the missile 10. Each of the fins is attached to the missile 10 in the same manner. A shroud 18 is attached to the missile 10 and the fins are adapted to project through slots in the shroud.

Figure 5:
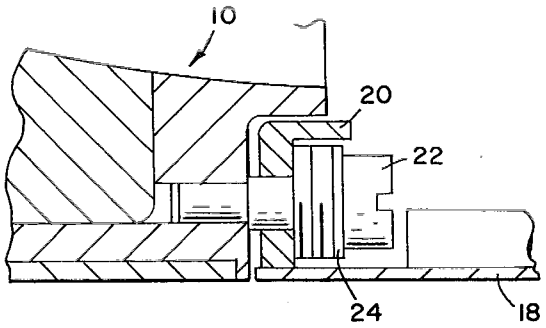
FIG. 5 is similar to FIG. 4 and shows the ring with the fin in extended position.
Figure 4:
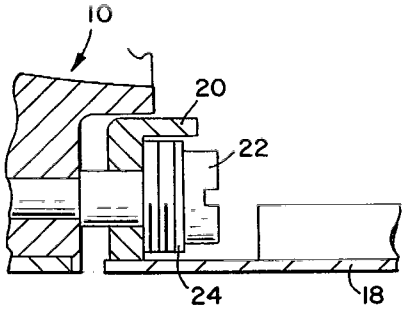
FIG. 4 illustrates the mounting for the movable ring associated with the fin shown in FIGS. 2 and 3 the fin being in retracted position.

A ring 20 is mounted to the rear of missile 10 by several shouldered bolts 22 as illustrated in FIGS. 4 and 5. The ring 20 is freely slideable on the bolts 22 and a series of Belleville type spring washers 24 are located between the ring and the heads of the bolts.

At four points spaced around the periphery of the rings are outwardly projecting lugs or bosses 26. The hub portion 28 of the fin 12 is positioned between lugs 26 and a hinge pin 30 pivotally mounts the fin 12 to the ring 20. A projecting lug 32 is formed integral with each hub 28 and bears against the rear surface of the missile 10.

Figure 2:
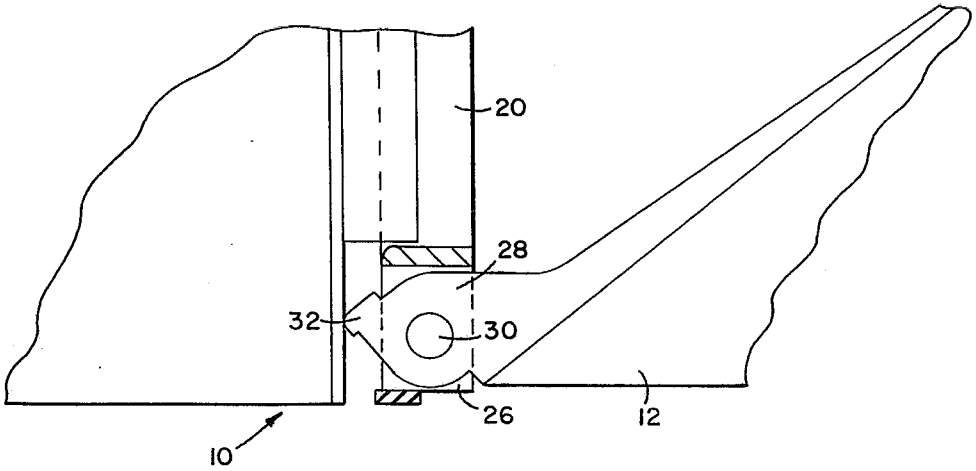
FIG. 2 is a section illustrating the fin mounting shown with the fin in retracted position.
Figure 1:
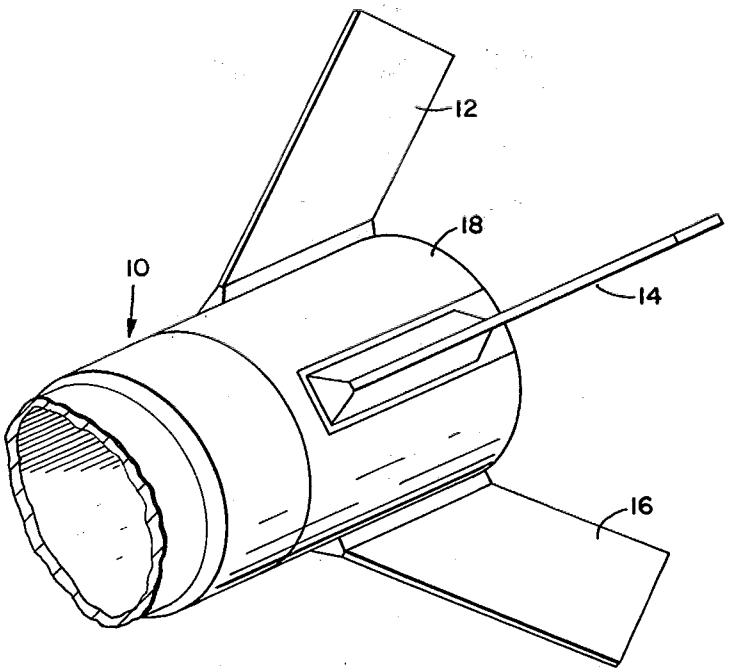
FIG. 1 is a perspective of the rear portion of a missile illustrating the fins of the present invention.

As the fin 12 moves outwardly from the position illustrated in FIG. 2 the position illustrated in FIG. 3, the ring 20 moves closer to the rear surface of the missile 10 under the influence of the Belleville springs 24. The projecting lug 32 prevents return of the fin 12 to its closed position.

Figure 7:
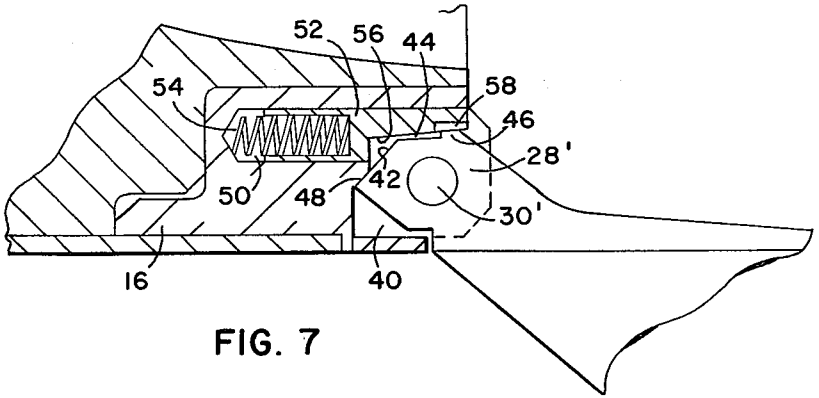
FIG. 7 is similar to FIG. 6 but shows the fin in extended position.
Figure 6:
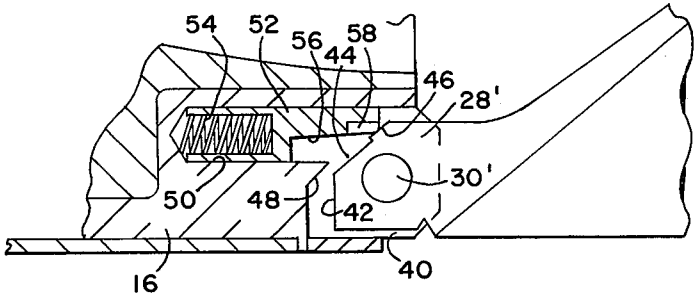
FIG. 6 shows a different fin mounting structure with the fin in retracted position.

Referring now to FIGS. 6 and 7 two spaced lugs or bosses 40 are formed at four points around the periphery of the rear of the missile 10 and project rearwardly therefrom. In this configuration the fin 12 is provided with a hub 28' pivotally mounted on a hinge pin 30' which extends between the lugs 40.

The hub 28' is provided with a flat surface 42. Another flat surface 44 is adjacent to flat surface 42 and at an angle with respect thereto. A lug 46 projects outwardly from the flat surface 46.

The rear of the missile 10 is provided adjacent the fin hub 28' with a diagonal flat surface 48. Adjacent each hub 28', the rear of the missile 10 is provided with a recess 50. A plunger 52 is slidably received in each recess 50 and is spring pressed rearwardly by a spring 54. The plunger 52 is provided with an outwardly facing flat surface 56. The rearmost end of the surface 56 is cut out as recessed as indicated at 58.

As the fin 12 moves from its retracted position illustrated in FIG. 6 to its extended position illustrated in FIG. 7 the flat surface 42 on the hub 28' abuts the flat surface 48 on the rear of missile 10 to limit the outward movement of the fin 12. The plunger 52 moves rearwardly under the influence of the spring 54 until the flat surface 56 thereon abuts the flat surface 44 on the hub 28' thus wedging the fin 12 in its extended position. The lug 46 is received within the recess 58 on the plunger 52 to further lock the fin 12 in its extended position.

Figure 9:
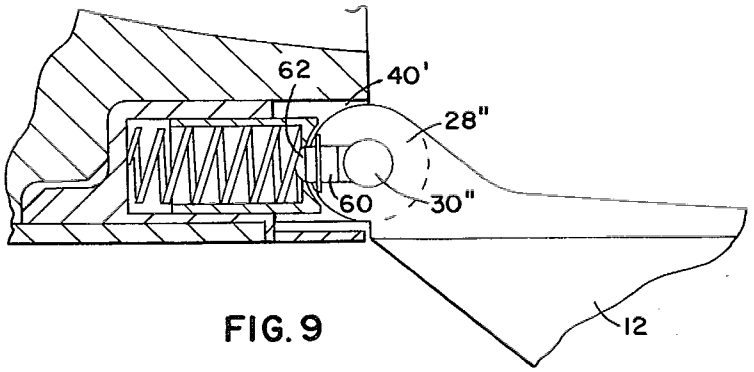
FIG. 9 is similar to FIG. 8 but shows the fin in extended position.
Figure 8:
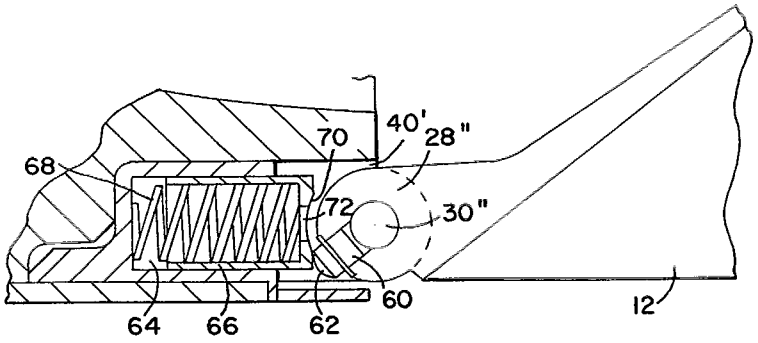
FIG. 8 illustrates another embodiment of the fin mounting structure with the fin in retracted position.

Referring now to the modification illustrated in FIGS. 8 and 9, the hub 28'' of the fin 12 is mounted between two lugs 40' on the missile 10 by a hinge pin 30''. The hub 28'' is provided with a radially extending pin 60 which projects slightly beyond the periphery of the hub 28''. As shown in the drawings the outer end of pin 60 is rounded.

A recess 64 is provided in the rear portion of the missile 10 and a plunger 66 is slideably mounted in the recess 64. A spring 68 normally urges the plunger 66 rearwardly toward the hub 28''. The rearmost end of plunger 68 is arcuate as shown at 70 and is provided with a central circular recess 72.

When the fin 12 moves from its retracted position shown in FIG. 8 to its extended position shown in FIG. 9, the pin 60 is aligned with the recess 72 in the plunger 66. The plunger 66 then moves rearwardly under the influence of spring 68 until the recess 72 embraces the pin 60 to lock the fin 12 in its extended position.

Figure 11:
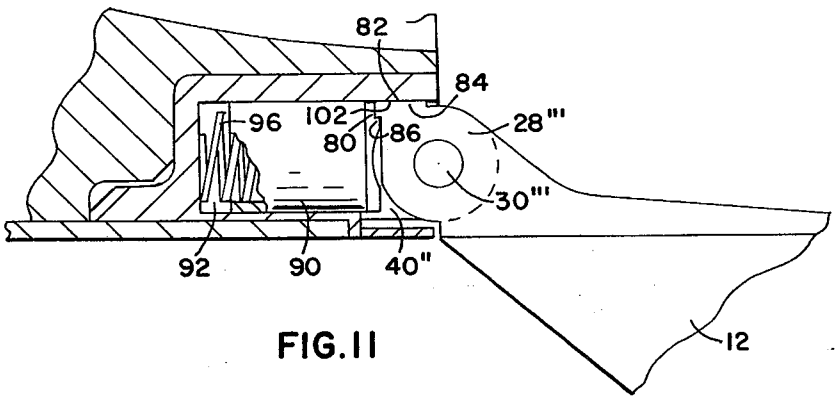
FIG. 11 is the same as FIG. 10 but shows the fin in extended position.
Figure 10:
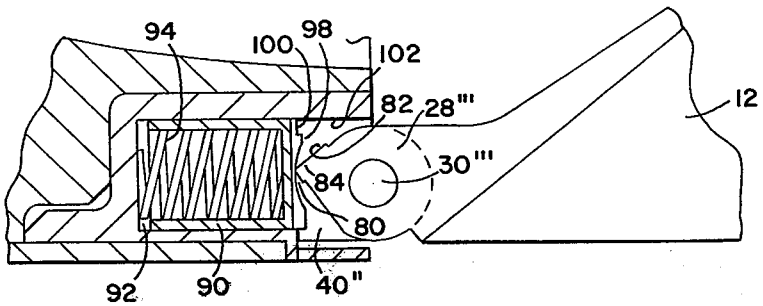
FIG. 10 shows still another fin mounting with the fin shown in retracted position.

In the modification shown in FIGS. 10 and 11, the fin 12 is provided with a hub 28''' mounted on a hinge pin 30''' between lugs 40''. The hub is provided with two flat surfaces 80 and 82 formed at substantially right angles with each other on a lug 84 formed on the hub 28'''. The surface 80 is recessed to provide a lip 86.

A plunger 90 is slideable in a recess 92 formed in the rear of missile 10. A spring 94 normally urges the plunger 90 rearwardly toward the hub 28'''. The rearward end 98 of the plunger 90 is arcuate and the end of the arcuate section is cut off as indicated at 100.

When the fin 12 moves from its retracted position illustrated in FIG. 10 to its extended position illustrated in FIG. 11, the lug 84 rides on the arcuate end portion 98 of plunger 90. When the fin 12 is fully extended the flat surface 82 on the lug 84 abuts a surface 102 on the rear of missile 10 limiting further extension of fin 12. At this point the lip 86 on lug 84 is aligned with the recess 100 on the plunger 90. The spring 94 urges the plunger 90 rearward interengaging the lip 86 and the recess 100 prevent inward movement of the fin 12.

I claim:

1. A flip out tail assembly for a missile comprising a ring adjacent the rear end of the missile, bolts mounting said ring for axial movement relative to said missile, spring means between said ring and the heads of said bolts normally urging said ring forward relative to said missile, four fins hinged to said ring equidistant therearound, a shroud assembly fixed to the missile having four longitudinal slots formed therein through which the fins are adapted to project, lug means on each of said fins adjacent the hinge point, flat surfaces on the rear portion of said missile for cooperation with said lug means whereby forward movement of said ring causes said fins to move outwardly and lock in extended position.

2. A flip out tail assembly as set forth in claim 1 wherein the spring means between said ring and said bolt heads are Belleville type spring washers.

* * * * *